US006035452A

United States Patent [19]

Braxton

[11] Patent Number: 6,035,452

[45] Date of Patent: Mar. 14, 2000

[54] EXPANSIBLE PROTECTIVE BODY POUCHES EMPLOYING REMOVABLE-REPLACEABLE COMPONENTS

[76] Inventor: Michael D Braxton, P.O. Box 2882, Citrus Heights, Calif. 95610

[21] Appl. No.: 09/137,541

[22] Filed: Aug. 21, 1998

Related U.S. Application Data

[60] Provisional application No. 60/060,511, Sep. 30, 1997.

[51] Int. Cl.[7] ..... A41D 13/00

[52] U.S. Cl. ..... 2/455; 2/463; 2/467; 2/908; 2/267; 2/16; 2/24

[58] Field of Search ..... 2/455, 463, 464, 2/465, 467, 459, 462, 44, 45, 22, 24, 16, 92, 908, 69, 267, 250, 251, 252, 247, 2.5

[56] References Cited

U.S. PATENT DOCUMENTS

| | | | |
|---|---|---|---|
| 3,135,961 | 6/1964 | Roderick | 2/2 |
| 3,866,909 | 2/1975 | DeSantis | 272/76 |
| 4,441,211 | 4/1984 | Donzis | 2/2 |
| 4,507,802 | 4/1985 | Small | 2/2.5 |
| 4,599,747 | 7/1986 | Robinson | 2/461 |
| 4,642,814 | 2/1987 | Godfrey | 2/24 |
| 4,697,285 | 10/1987 | Sylvester | 2/2 |
| 4,870,706 | 10/1989 | Ketham et al. | 2/2 |
| 5,052,052 | 10/1991 | Gilford et al. | 2/69 |
| 5,168,576 | 12/1992 | Krent et al. | 2/267 |
| 5,187,812 | 2/1993 | Neuhalfen | 2/2 |
| 5,325,538 | 7/1994 | Schoenweiss et al. | 2/2.5 |
| 5,375,262 | 12/1994 | Carter | 2/23 |
| 5,398,340 | 3/1995 | Kibbee | 2/2.5 |
| 5,524,641 | 6/1996 | Battaglia | 128/846 |
| 5,605,144 | 2/1997 | Simmons et al. | 126/204 |
| 5,742,947 | 4/1998 | Davis | 2/463 |
| 5,790,981 | 8/1998 | Bzoch | 2/22 |

*Primary Examiner*—John J. Calvert
*Assistant Examiner*—Tejash Patel
*Attorney, Agent, or Firm*—Heisler & Associates

[57] ABSTRACT

Expansible sport protective body pouches for torso and extremities are disclosed that dissipate impact energy away from the body by expanding and compressing at predesigned rates when subjected to the forces of impact trauma. Comprised of anatomically-shaped two layer expansible protective pouches, and removable replaceable internal impact deceleration control components, the design allows individual deceleration control elements; foam impact dispersant replaceable inserts with impact deceleration-body heat venting apertures, and replaceable penetration resistant impact trauma shields with impact deceleration control-body heat venting apertures, to be inserted or removed from the replaceable expansible protective pouch. The expansible protective pouch is constructed of various cloth material combinations selected by the wearer; internal impact deceleration control element materials are also a plurality wearer option. The expansible protective pouch and it's ancillary internal components can be completely disassembled in the field to facilitate replacement, upgrades, or exchanging of elements, including the protective pouch, so as to alter individual protective pouch performance characteristics.

6 Claims, 18 Drawing Sheets

15
16
13
14
12
23
23
20
23
17
23
30
18
31
18
17
19
51
23
17
20
12

38
42
37
44
45
42
90
43
42

90
90
37
42
43
90

47
52
52
55
53
93
54
46
52

EXPANSIBLE PROTECTIVE BODY POUCHES EMPLOYING REMOVABLE-REPLACEABLE COMPONENTS

CROSS REFERENCE TO RELATED APPLICATION

This application claims benefit of Provisional Patent application Ser. No. 60/060,511, filed Sep. 30, 1997.

STATEMENT REGARDING FEDERALLY SPONSORED RESEARCH OR DEVELOPMENT

Not applicable.

FIELD OF INVENTION

This invention relates to individual anatomically-shaped torso and extremity protective pouches worn while participating in sporting activities and more particularly, anatomically-shaped torso and extremity protective pouches worn beneath outer wear that expand upon impact to dissipate impact trauma away from the body, and also have the ability to be disassembled for repair, replacement of parts, or to alter performance characteristics of individual protective pouches.

BACKGROUND ART

Known prior art torso and extremity protection designs for sporting activities; motorcycling, automobile racing, jet skiing, and mountain biking, for example, consist of hard plastic outer shells which are permanently affixed to single or multiple layers of closed/open cell foam impact dispersants. Heat bonding, rivets, adhesives, and sewing are the more popular methods involved in this assembly process. Although inexpensive as manufacturing techniques go, the aforementioned processes severely restricts the impact dispersant foams intrinsic ability to naturally expand and compress as intended when subjected to the forces of impact trauma. This inability to naturally expand and compress as designed, which assists in decelerating and dispersing the force of the impact, has the unintended consequence of concentrating the majority of impact energy at the initial impact point. This concentration of impact force, further reduces the effectiveness of the closed/open foams attempts at dispersing harmful impact energy away from the wearer's body, as intended. These known prior art protective offerings not only are assembled contrary to the laws of physics, but also result in finished products that are stiff, raise body temperature, and are uncomfortable to wear.

Another major flaw in known prior art protection designs, is their inability to allow for the replacement of individual protection pouch components when damaged, or, as newer technology components are developed. Consumers owning these known prior art protection offerings are forced to either continue using the defective/older design(s) or bear the major expense of purchasing brand new protector(s).

Additionally, the inability to enhance known prior art protection designs performance characteristics (by replacing or interchanging components) to adjust for adverse weather and other unknown event conditions hinders sports participants from attaining personal optimum levels of performance during exertion.

SUMMARY OF INVENTION

Our invention seeks to achieve numerous design objectives which are intended to address the shortcomings illuminated in known prior art torso and extremity protection designs.

It is the objective of this invention to provide anatomically-shaped expansible torso and extremity protection pouches for sporting activities that dissipate impact energy away from the wearers body by expanding and compressing at predetermined designed rates when subjected to the forces of impact trauma.

It is also an objective of this invention to provide expansible anatomically-shaped torso and extremity protection pouches that permits nitrile foam impact dispersant replaceable inserts to intrinsically spread and compress at predetermined designed rates when subjected to the forces of impact trauma.

It is a further objective of this invention to provide torso and extremity expansible protection pouches that can be completely disassembled while in the field. It is also a further objective of this invention that consumers be able to change individual expansible protection pouch components deemed to be damaged, or in need of newer technology component replacements while in the field.

Another objective of this invention is to provide torso and extremity expansible protection pouches that give consumers the ability to interchange and substitute protection pouch components so as to alter the performance characteristics of specific torso and extremity expansible pouches while in the field.

It is still another objective of this invention to be user friendly. Our invention's design will be ergonomically pliable and not evoke a rise in body temperature.

Lastly, it is the objective of this invention to have consumers benefit from our invention's lower operating and replacement costs. It is far less expensive replacing or upgrading our present invention's individual removable-replaceable protective components rather than the known prior art practice of being compelled to purchase "brand new" replacement protectors!

The foregoing objectives have been attained by the present inventions primary use of anatomically-shaped expansible protective pouch systems for torso and extremities.

Designed to be worn beneath apparel, the present inventions use of the expansible protective pouch with removable replaceable internal impact deceleration control components, automatically upgrades the safety capabilities of any outer wear garment worn by sport participants.

The chest's anatomically-shaped expansible protective pouch consists of the replaceable, expansible cloth protection pouch with "inward fold access portal opening" and it's removable, replaceable internal impact deceleration control components i.e., primary nitrile foam impact dispersant replaceable insert with impact deceleration control-body heat venting apertures, and replaceable penetration resistant impact trauma shields with impact deceleration control-body heat venting apertures. Protection coverage is provided for the heart, lungs, sternum and ribs.

The back's anatomically-shaped expansible protective pouch consists of the replaceable, expansible cloth protection pouch with "inward fold access portal opening", detachable-adjustable elastic waist belts, removable-replaceable internal impact deceleration control components, i.e., primary nitrile foam impact dispersant replaceable insert with impact deceleration control-body heat venting apertures, and replaceable penetration resistant impact trauma shields with impact deceleration control-body heat venting apertures. Protection coverage is provided for the cervical vertebrae from the coccyx to the 6th cervical vertebrae and left and right scapula regions of the back. Coverage also extends to the left and right kidney areas of the body.

Anatomically-shaped expansible protective pouches for extremities', forearm/elbow, knee/shin, shoulder and hip/thigh, consists of the replaceable, expansible cloth protection pouch with "inward fold access portal opening"; removable, replaceable internal impact deceleration control components i.e., primary and secondary nitrile foam impact dispersant replaceable inserts with impact deceleration control-body heat venting apertures, and replaceable penetration resistant impact trauma shields with impact deceleration control-body heat venting apertures. Optional, abrasion-penetration resistant, flexible polyethylene impact trauma shields are available for forearm/elbow, and knee/shin which attach externally, while shoulder, and hip/thigh are inserted inside the expansible protective pouch.

Expansible protective pouch for extremities provides protection coverage for the wearer's elbow joint, and portions of the humerus, radius and ulna bones (forearm/elbow protective pouch), patella, and portions of the tibia and fibula bones (knee/shin protective pouch), shoulder joint and portions of the scapula, humerus, and clavicle bones (shoulder protective pouch), the hip joint along with portions of the ilium, and femur bones (hip/thigh protective pouch).

The present invention is worn by first placing the anatomically-shaped expansible back protective pouch on the back with the coccyx portion of the protective pouch covering the coccyx (tail bone). Grasping the free ends of the back protective pouch left and right detachable-adjustable elastic waist belts, the wearer then brings the belt ends around front of the body and adjusts/secures the elastic waist belt ends to each other just above the navel via the hook and loop adjusters sewn onto the free end of the elastic waist belts.

The present invention's anatomically-shaped expansible chest protective pouch is then inserted between the wearer's sternum and the back's elastic waist belts. The chest's expansible protective pouch is held into position by it's integrated hook facial adjuster that mates with the underside loop adjuster of the back's left side elastic waist belt. This well though out design encourages the wearing of the chest and back protective pouches as a one piece protection unit with a wide range of horizontal and vertical adjustment possibilities.

The present invention's anatomically-shaped expansible protective pouches for extremities' are worn beneath outer wear and are fully adjustable both vertically and horizontally. Hook attachment-adjusting systems are sewn onto the outside of the extremity pouches expansible outer cover. Mating loop fasteners in the outerwear secures extremity protective pouches in position. Forearm/elbow and knee/shin protective pouch systems can be attached directly to wearer's limbs. Elastic straps may be attached to the outside of the aforementioned protective pouches flexible polyethylene impact trauma shields.

When the present invention is subjected to the forces of impact energy it performs thus, the force of the impact is transmitted through the expansible protective pouch outer cover directly onto the penetration resistant impact trauma shields; one element of replaceable, removable, internal impact deceleration control components. Acting as impact load spreaders, the aforementioned shielding distributes the force of the impact evenly over the surface area of the primary and secondary nitrile foam impact dispersant replaceable inserts. It is at this point that the replaceable dispersant inserts, unencumbered inside the now expanding protective pouch, begins the process of decelerating the impact force by utilizing the foam inserts intrinsic ability to expand and compress at predetermined designed rates whenever affected by outside impact energy. Assisting in maximizing the efficiency of this deceleration process, are impact deceleration control-body heat venting apertures of the impact trauma shields and replaceable dispersant inserts. Channeling the flow of trapped ambient air caused by impact forces through these exiguous airways, the resulting compression of ambient air derived as a consequence of the induced impact force, and the dispersant insert(s) intrinsic natural behaviour, translates into further deceleration and increased dispersion of the impact force away from the wearers body.

The present invention's expansible protective pouch and impact deceleration control components, return to their natural state upon the secession of outside impact energy.

The aforementioned process is further enhanced by the present invention's use of optional, abrasion-penetration resistant, flexible polyethylene impact trauma shields for extremity expansible protective pouches'.

In a preferred embodiment of the invention, the torso and extremity expansible protective pouches are comprised of two panels. A breathable abrasion resistant stretch outer cover, and a breathable nylon mesh stretch back cover.

Each expansible protective pouch of the preferred embodiment features the "inward fold access portal opening". It is the "access portal opening" that makes insertion and removal of the replaceable internal impact deceleration control components possible. Each access portal opening secures inwardly to reduce the possibility of damage due to abrasion, snagging, or expansion. The access portal opening is secured by way of a hook & loop fastening system sewn directly onto the inward fold material of the expansible protective pouch.

To properly align certain of the removable replaceable internal impact deceleration control components within the preferred embodiments expansible protective pouch, nylon mesh stretch alignment pockets are sewn into position on the underside of each expansible protective pouch. The chest's expansible protective pouch receives three nylon mesh stretch alignment pockets located along the center chest vertical linear axis, and the left and right chest quadrants. The back's expansible protective pouch receives five nylon mesh stretch alignment pockets located along the center back vertical linear axis, and upper left, upper right, lower left, and lower right lateral back quadrants. Impact trauma shield elements of the internal impact deceleration control components are inserted into these nylon mesh stretch alignment pockets after the assembly of each expansible protective pouch.

Extremity expansible protective pouches of the preferred embodiment receive nylon stretch mesh alignment pockets as follows: forearm/elbow protective pouch; five alignment pockets, center line vertical axis, and lower right, lower left, upper right, and upper left lateral quadrants. Knee/shin protective pouch; five alignment pockets, center line vertical axis, and lower right, lower left, upper right, and upper left lateral quadrants. Shoulder protective pouch; four alignment pockets, upper oblique linear axis, upper center oblique, mid center oblique, and lower oblique linear axis. Hip/thigh protective pouch; four alignment pockets, upper oblique linear axis, upper mid oblique, mid oblique, and lower oblique linear axis. Alignment pockets of the extremity expansible protective pouch contain the removable elements; secondary nitrile foam impact dispersant, and impact trauma shields of the internal impact deceleration control components.

The outer and back cover panels of the preferred embodiments extremity expansible protective pouch are assembled inside out prior to sewing. This procedure insures that stitches are not subject to abrasion, snagging, or expansion damage.

The back expansible protective pouch of the preferred embodiment features adjustable elastic waist belts that attach to the lower right, and lower left quadrants of the back preferred embodiments expansible outer cover. These elastic belts can be adjusted vertically, horizontally, or completely removed when the back preferred embodiment is installed into the wearer's garments. The chest expansible protective pouch of the preferred embodiment features an integrated hook facial adjusting system sewn into position on the outside of the chest preferred embodiments expansible protective pouch outer cover.

The extremity expansible protective pouch of the preferred embodiment features a hook attachment-adjusting system sewn onto the outside of the extremity preferred embodiments expansible protective pouch outer cover.

An alternate embodiment of the present invention uses nitrile foam impact dispersant replaceable inserts, or other effective impact dispersants, positioned as a second layer of preventative impact trauma protection for the upper cervical vertebrae region of the back. Shaped into discs the approximate size of silver dollars, these additional protective elements, along with their removable impact trauma shields, are held into position by nylon mesh stretch alignment pockets sewn onto the underside to the alternate embodiments expansible protective pouch outer cover.

Another embodiment of the present invention uses an expansible protective pouch comprised of two nylon mesh stretch panels. This embodiment of the present invention provides maximum air flow and perspiration evaporation.

Another embodiment of the present invention uses an expansible protective pouch comprised of two fire resistant stretch panels.

In still another embodiment of the present invention a penetration, slice resistant material replaceable insert is used as an additional wearer protection option.

In yet another embodiment of the present invention an additional layer of nitrile foam impact dispersant replaceable insert, or other suitable dispersant insert, is installed into existing nylon mesh stretch alignment pouches of each torso and extremity expansible protective pouch.

Our present invention's choice of expansible protective pouch material alternatives, trauma shielding types, foam impact dispersant inserts of differing expansion/compression rates, and alternative protective replaceable insert options, are only limited by our own imagination and the availability of newer and better materials.

BRIEF DESCRIPTION OF SEVERAL VIEWS OF THE DRAWINGS

The advantages, objects and features of the invention just detailed will become evident to anyone when viewed in conjunction with the following drawings.

DESCRIPTION OF THE PREFERRED EMBODIMENT

Preferred embodiments of the invention will now be portrayed and are evidenced by the drawings.

Figure 1:
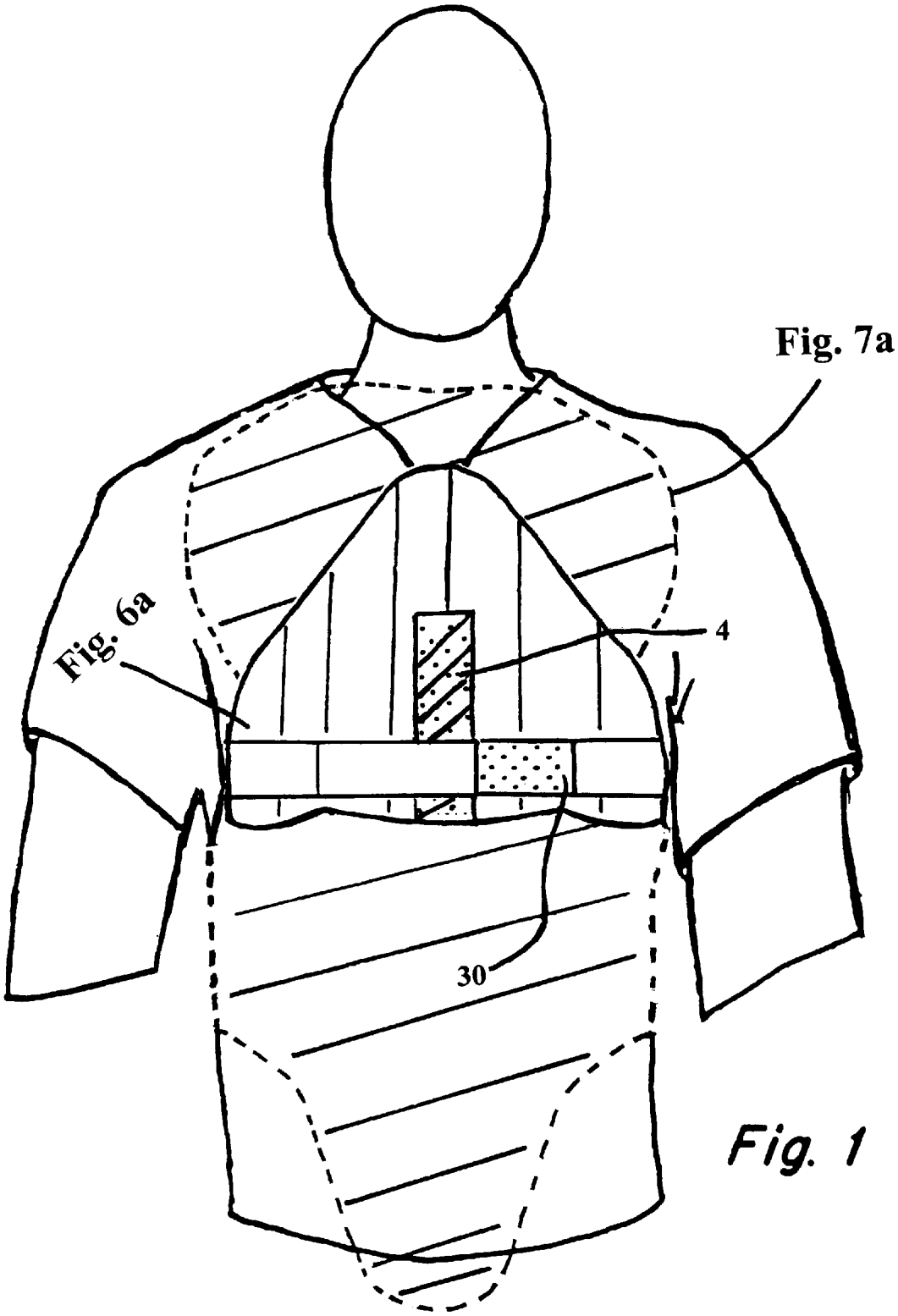
FIG. 1 is a frontal view of said chest and back protective pouch embodiments being worn as one operable protection device.
Figure 2:
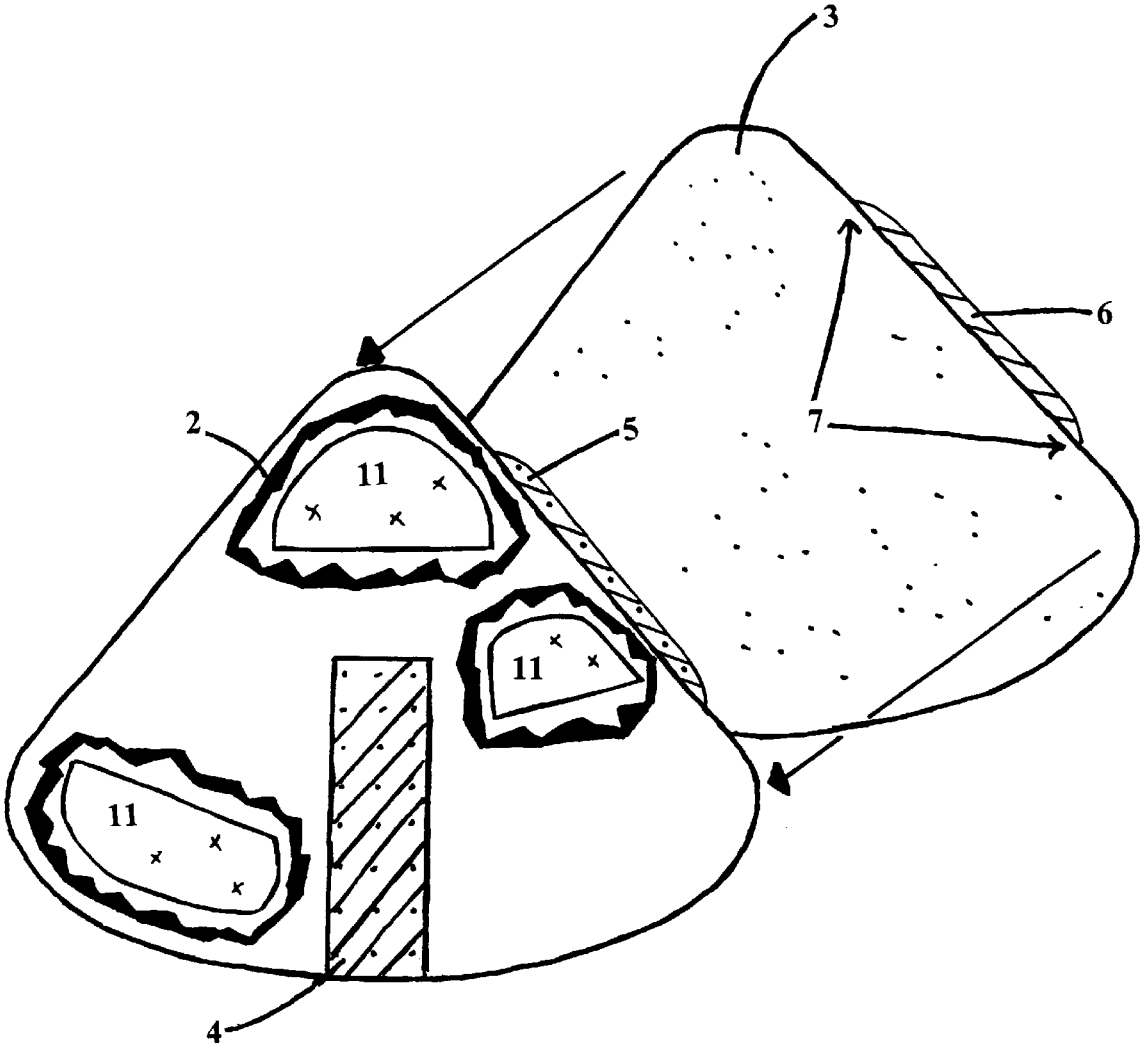
FIG. 2 is an exploded view of said chest's expansible cloth protection pouch.
Figure 4:
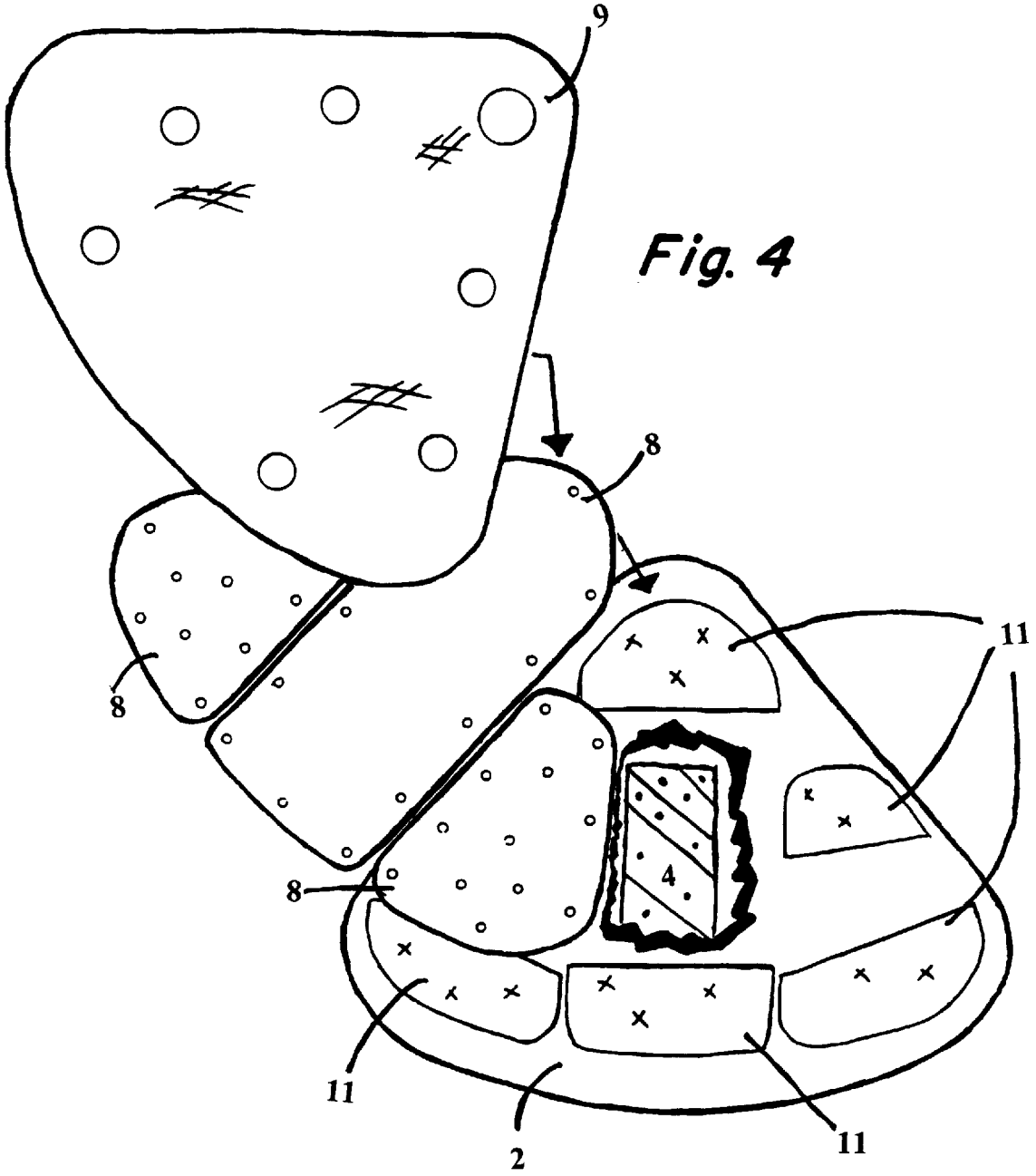
FIG. 4 is an exploded rear view of said chest protection pouch's removable-replaceable internal impact deceleration control components.
Figure 6:
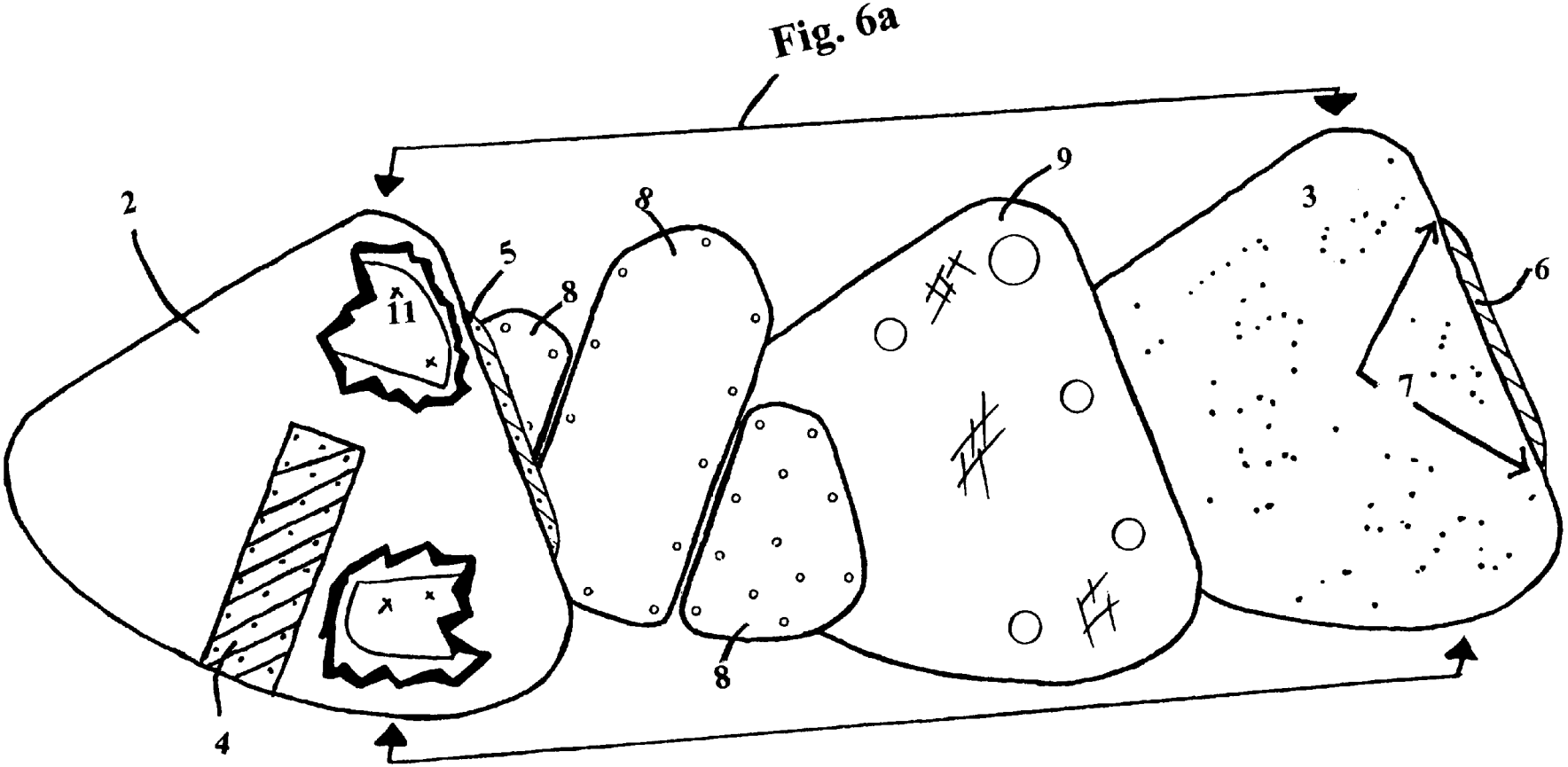
FIG. 6 is an exploded view of said chest protection pouch preferred embodiment. Reference arrow "FIG. 6*a*" in figures one and six reference the entire chest protector.

FIG. 1, represents the frontal view of the the preferred chest (FIG. 6) and back (FIG. 7) protection pouch embodiments when worn as one operable device beneath outerwear. The chest's expansible cloth protection pouch consists of two panels 2 and 3, as shown in FIG. 2. The outer cover, 2, is constructed from one layer of expansible, breathable, abrasion resistant stretch material. The back cover, 3, is constructed from one layer of breathable nylon mesh stretch material. A six inch hook adjusting system, 4, as shown in FIGS. 1 and 2, which gives the wearer horizontal and vertical adjustment capabilities, is centered and sewn onto the outside of said chest's replaceable expansible cloth protection pouch outer cover, 2, as shown in FIGS. 2, 4, and 6. The chest's replaceable expansible cloth protection pouch, FIG. 2, also features an inward fold access portal opening, 7. It is through this opening that all removable replaceable internal impact deceleration control components consisting of a replaceable nitrile foam impact dispersant insert, 8, and impact trauma shields, 9, as shown in FIGS. 4 and 6, are inserted and removed. The eight and one half inch hook and loop closure, 5 and 6, as shown in FIG. 2, folds and secures inwardly to reduce the chance said access portal opening will sustain snagging or abrasion damage.

Prior to assembly, three nylon mesh stretch alignment pockets, 11, as shown in FIGS. 2, 4, and 6, are positioned and then sewn onto the underside of said chest's replaceable expansible cloth protection pouch outer cover, 2, as shown in FIGS. 2, 4 and 6. Said alignment pockets, 11, as shown in FIGS. 2, 4 and 6, properly position said chest's replaceable penetration resistant trauma shields, 8, as shown in FIGS. 4 and 6, once said trauma shields, 8, are inserted into said alignment pockets 11, of said chest's replaceable expansible cloth protection pouch outer cover, 2, as shown in FIGS. 2, 4 and 6. Outer and back covers of said chest's replaceable expansible cloth protection pouch 2 and 3, as shown in FIGS. 2 and 6, are assembled inside out prior to sewing in order to avoid abrasion damage to the thread. Nylon thread is used at thirteen stitches per inch for strength and durability. Said replaceable penetration resistant trauma shields, 8, as shown in FIGS. 4 and 6, are inserted into said alignment pockets 11, as shown in FIGS. 2, 4 and 6, after said assembly of each replaceable expansible chest protection pouch, FIG. 2.

Figures 3, 3A:
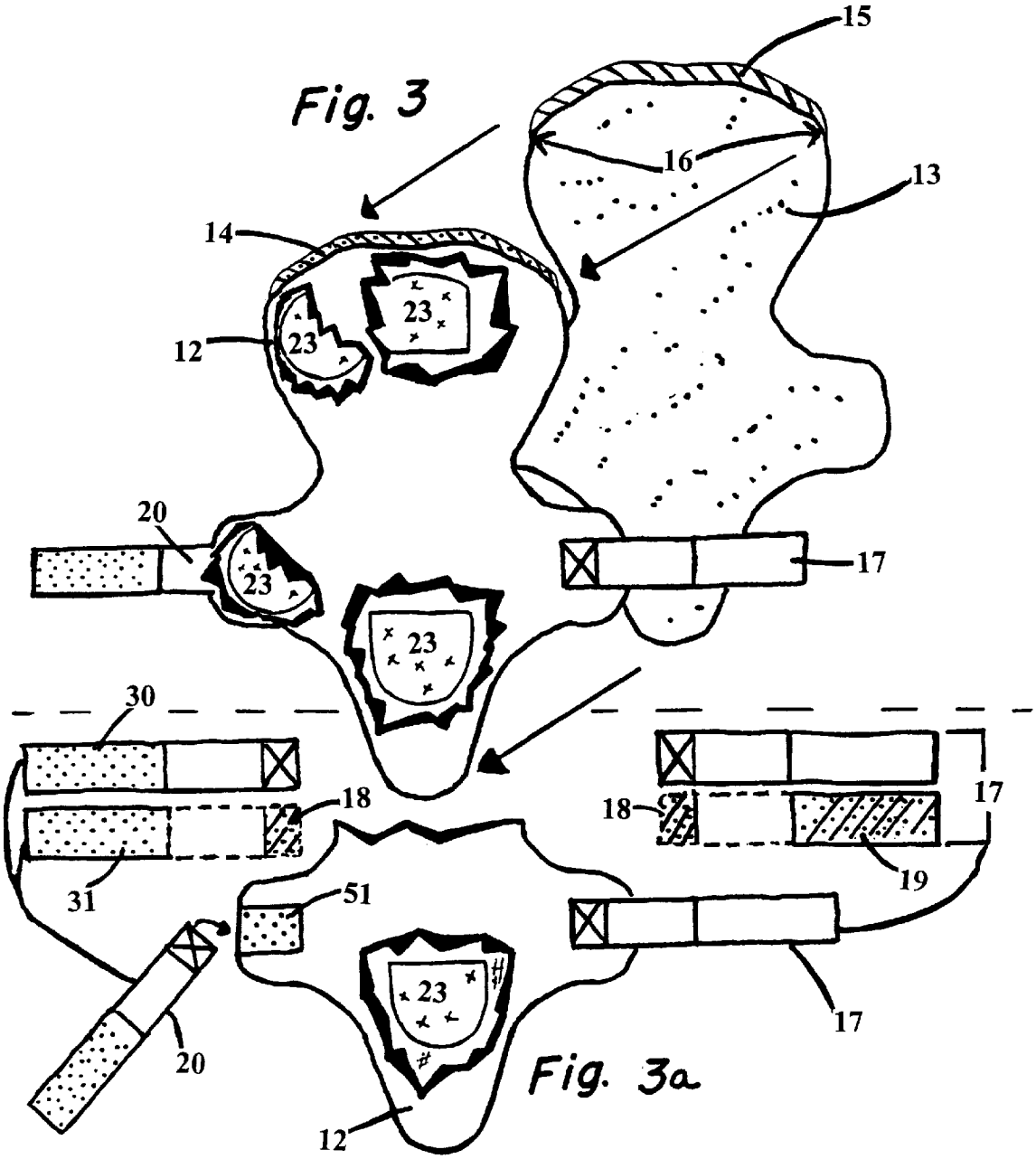
FIG. 3 is an exploded view of said back's expansible cloth protection pouch.
FIG. 3*a* is a view of said back protection pouch's detachable-adjustable waist belts.
Figure 5:
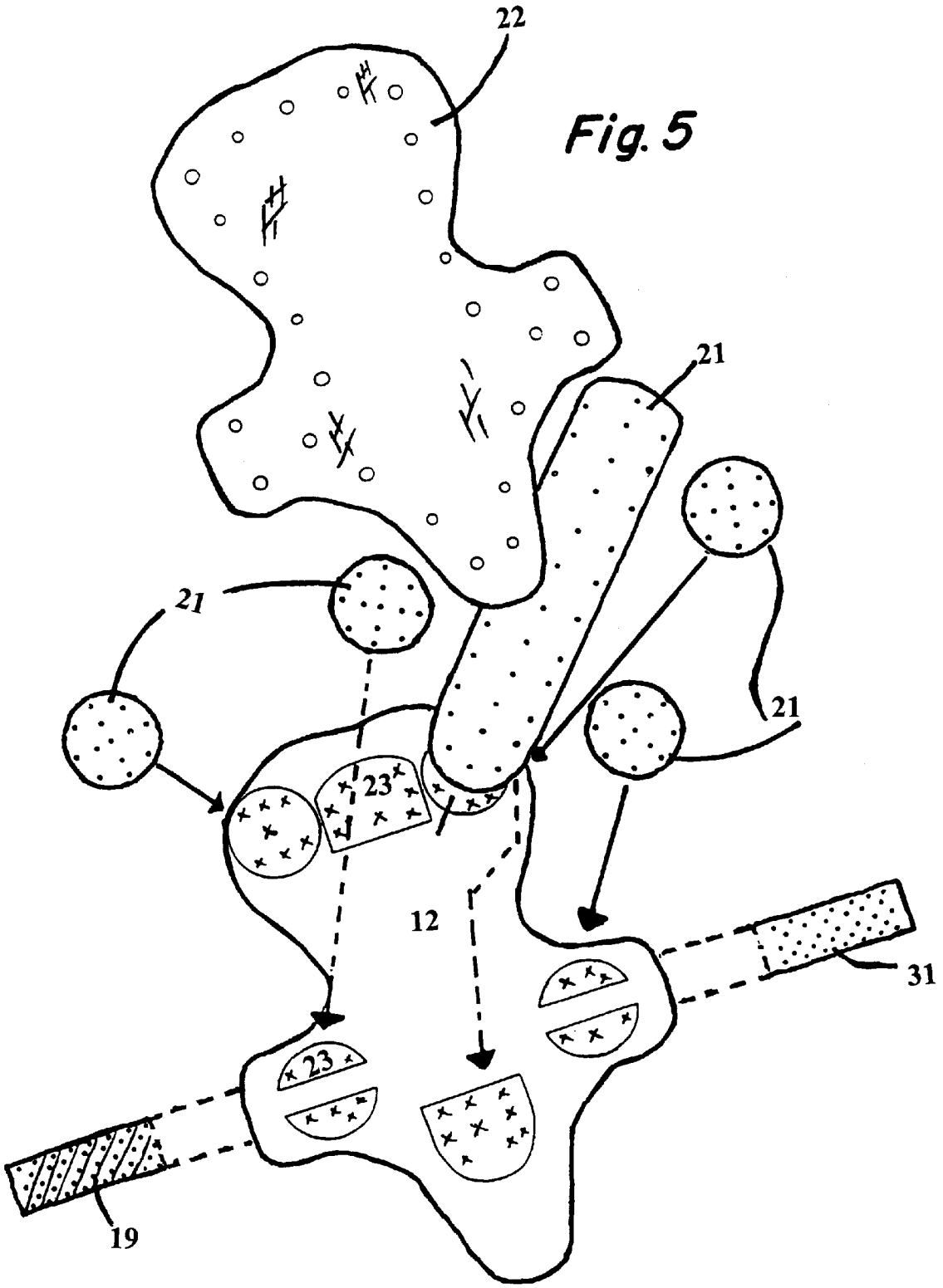
FIG. 5 is an exploded inside view of said back protection pouch's removable-replaceable internal impact deceleration control components.
Figure 7:
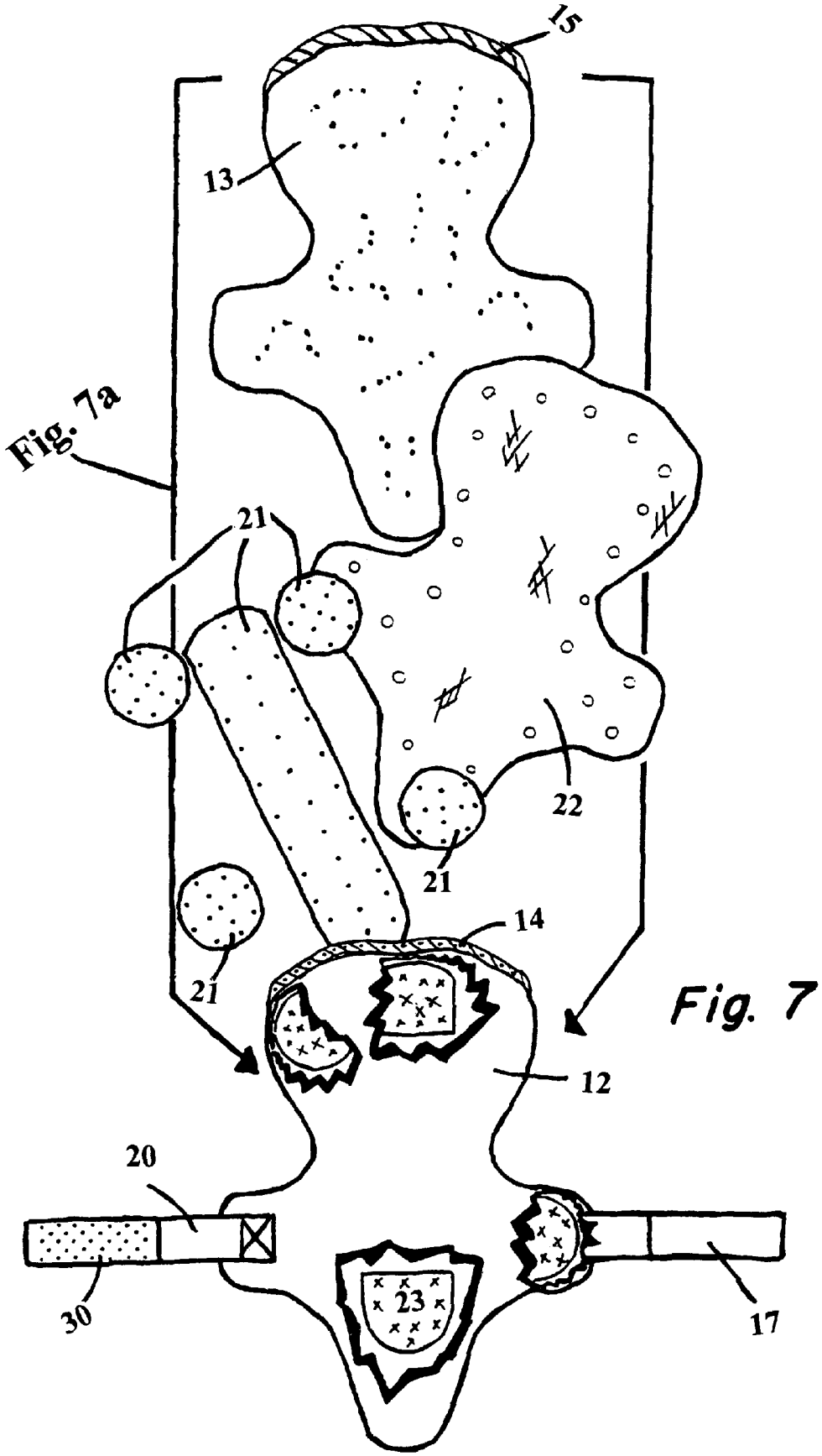
FIG. 7 is an exploded view of said back protection pouch preferred embodiment. Reference arrow "FIG. 7*a*" in figures one and seven reference the entire back protector.

The back's expansible cloth protection pouch consists of two panels, 12 and 13, as shown in FIG. 3. The outer cover, 12, is constructed from one layer of expansible, breathable, abrasion resistant stretch material. The back cover 13, is constructed from one layer of breathable nylon mesh stretch material. Two inch by three inch loop adjusting/fastening pads, 51, as shown in FIG. 3*a,* are sewn onto the kidney protection portion of said back protection pouch outer cover, 12, as shown in FIG. 3*a.* Said lop adjusting/fastening pads, 51, as shown in FIG. 3*a,* are used to attach said detachable-adjustable elastic waist belts, 17 and 20, to said back's replaceable expansible cloth protection pouch outer cover, 12, as shown in FIG. 3*a.* The back's replaceable expansible cloth protection pouch FIG. 3, also features an inward fold access portal opening, 16, as shown in FIG. 3. It is through this opening that all removable replaceable internal impact deceleration control components consisting of a primary nitrile foam impact dispersant replaceable insert, 22, and impact trauma shields, 21, as shown in FIGS. 5 and 7, are inserted and removed. The eleven inch hook and loop closure, 14 and 15, as shown in FIG. 3, folds and secures inwardly to reduce the chance of said access portal sustaining snagging or abrasion damage. Prior to assembly, five nylon mesh stretch alignment pockets, 23, as shown in FIGS. 3, 5 and 7, are positioned and then sewn onto the underside of said back's replaceable expansible cloth protection pouch outer cover, 12, as shown in FIGS. 3, 5 and 7. Said alignment pockets, 23, as shown in FIGS. 3, 5 and 7, properly position said back's replaceable penetration resistant trauma shields, 21, as shown in FIGS. 5 and 7, once said trauma shields, 21, are inserted into said alignment pockets, 23 of said back's replaceable expansible cloth protection pouch outer cover, 12, as shown in FIGS. 3, 5 and 7. Outer and back covers of said back's replaceable expansible cloth protection pouch, 12 and 13, as shown in FIG. 3, are assembled inside out prior to sewing in order to avoid abrasion damage to the thread. Nylon thread is used at thirteen stitches per inch for strength and durability. Said replaceable penetration resistant trauma shields, 21, as shown in FIGS. 5 and 7, are inserted into said alignment pockets 23, as shown in FIGS. 5 and 7, after said assembly of each replaceable expansible back protection pouch, FIG. 3.

Said detachable-adjustable elastic waist belts as shown in FIG. 3*a,* consists of right, 17, and left, 20 elastic belts two inches in width (length of belts vary). Both belts have two inch by one and one half inch hook adjusting/fastening pads, 18, as shown in FIG. 3*a,* sewn onto the underside of each belt. The right belt, 17, as shown in FIG. 3*a,* has a five and one half inch hook adjuster, 19, sewn onto it's underside at the free end of said belt. The left belt, 20, as shown in FIG. 3*a,* has two five and one half inch loop adjusters sewn onto the top, 30, and underside, 31, as shown in FIG. 3*a,* at said belt's free end. The left belt underside loop adjuster, 31, mates with said chest protection pouch integrated hook facial adjuster, 4, as shown in FIG. 1. Said aforementioned arrangement, gives both chest and back expansible protection pouches vertical and horizontal adjustment capabilities. Said detachable-adjustable elastic waist belts, 17 and 20, as shown in FIG. 3*a,* can be adjusted vertically, horizontally, or completely removed when said back's expansible protection pouch is installed into wearer's garments.

Figure 8:
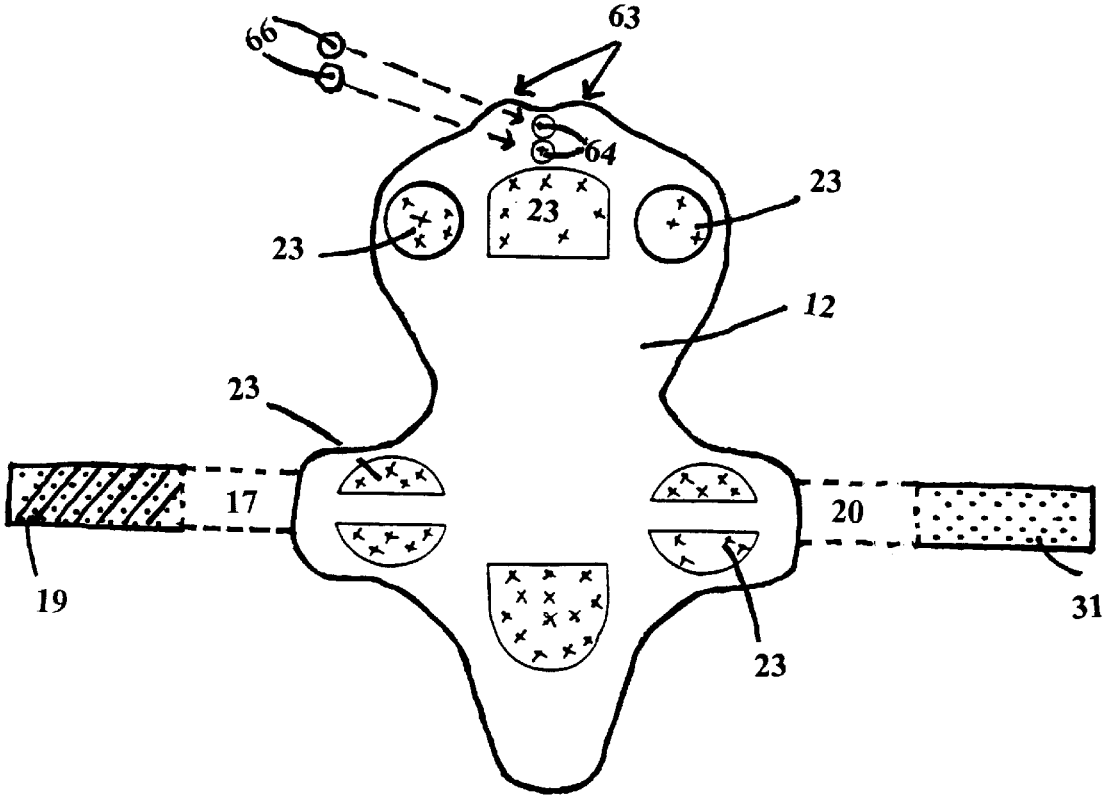
FIG. 8 is an inside view of back back's protection pouch outer cover: an alternative embodiment.

Another embodiment of said back's protection pouch uses one anatomically-shaped, replaceable nitrile foam impact dispersant insert with upper center cervical protection extension (not shown). This protection extension is represented, however, by number 63, as shown in FIG. 8. This inside view of said back's expansible outer cover, 12, as shown in FIG. 8, clearly shows the upper center cervical extension, 63, as shown in FIG. 8. Additional mesh stretch alignment pockets, 64, as shown in FIG. 8, are sewn onto the underside of said back's protection pouch outer cover, 12, as shown in FIG. 8. The aforementioned mesh stretch alignment pockets, 64, as shown in FIG. 8, accomodates nitrile foam impact dispersant inserts, shaped into discs the approximate size of silver dollars, 66, as shown in FIG. 8. Replaceable penetration resistant impact trauma shields (not shown) are also inserted into said mesh stretch alignment pockets, 64, as shown in FIG. 8.

Figures 9, 9A:
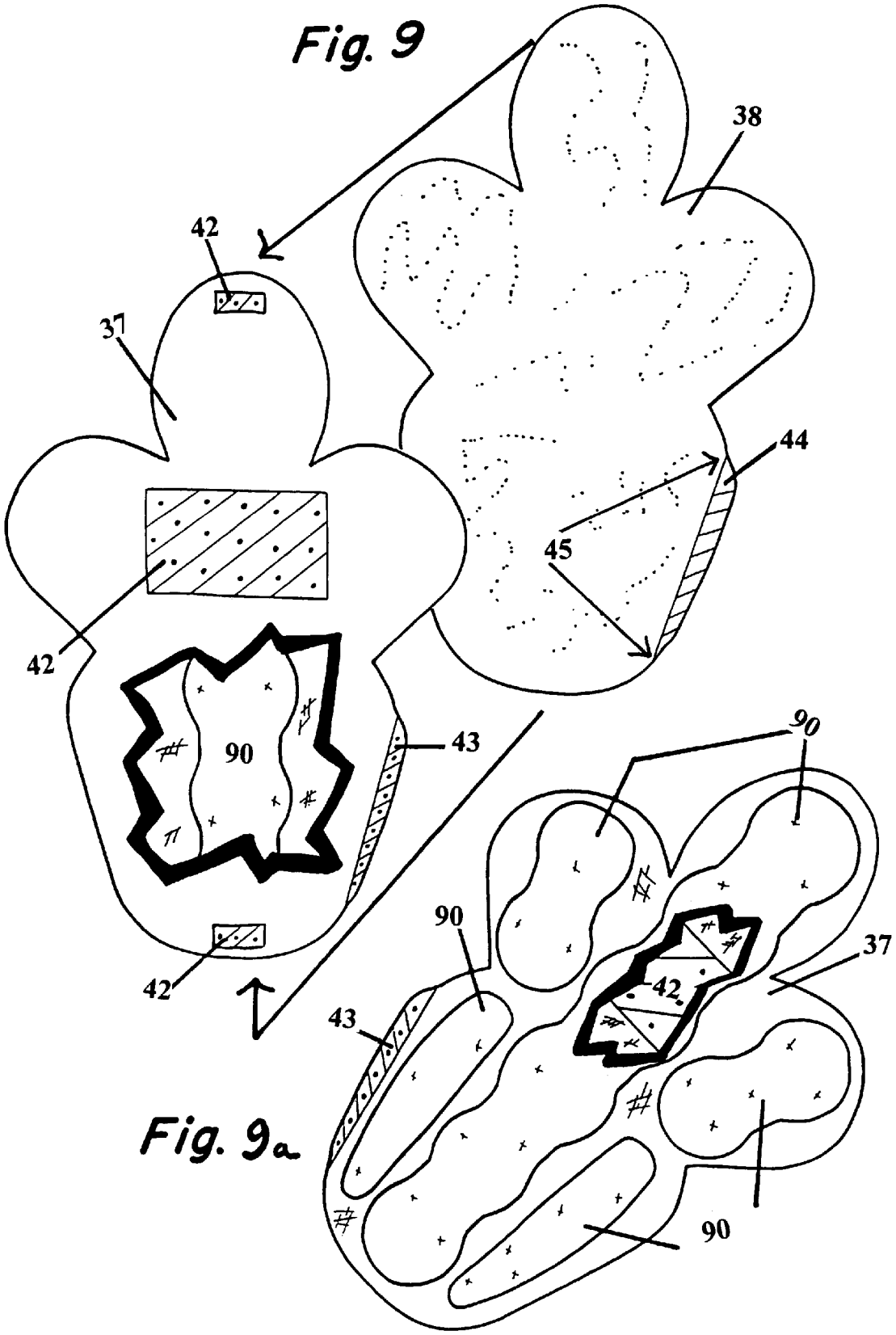
FIG. 9 is an exploded view of said forearm/elbow expansible cloth protection pouch.
FIG. 9*a* is an inside view of said forearm/elbow protection pouch outer cover.
Figure 11:
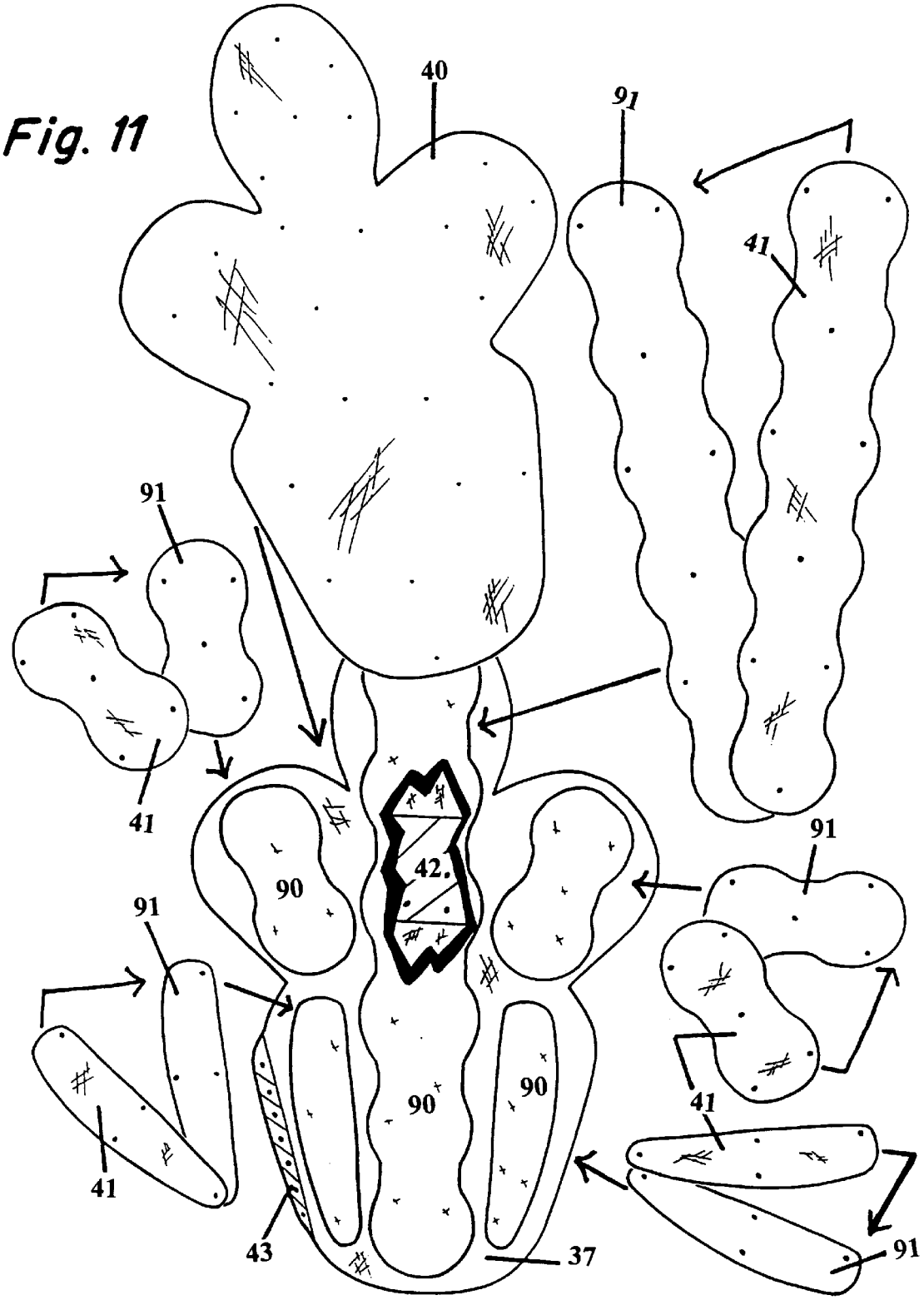
FIG. 11 is an exploded view of said forearm/elbow protection pouch preferred embodiment (sans back cover).
Figure 12:
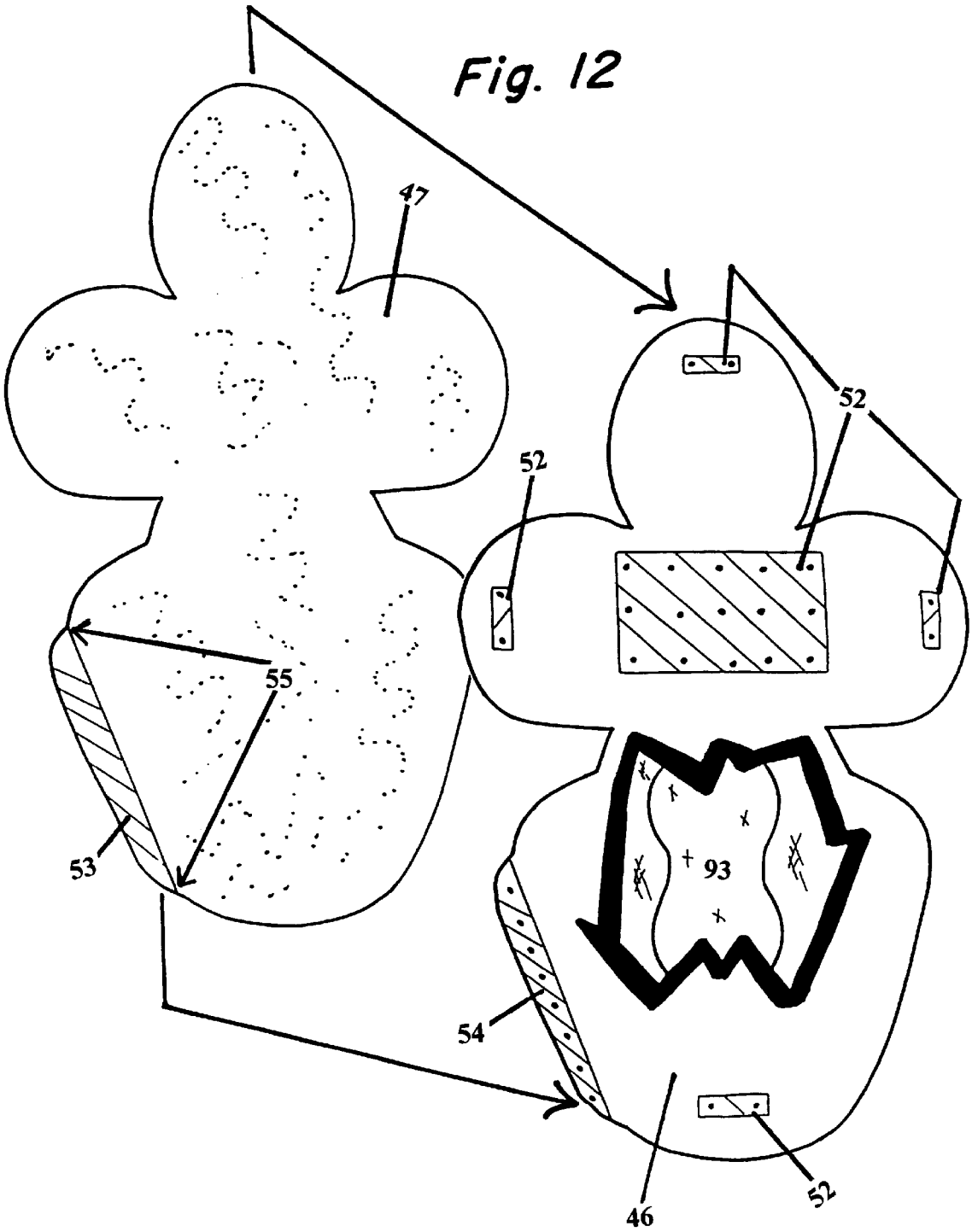
FIG. 12 is an exploded view of said knee/shin expansible cloth protection pouch.
Figure 14:
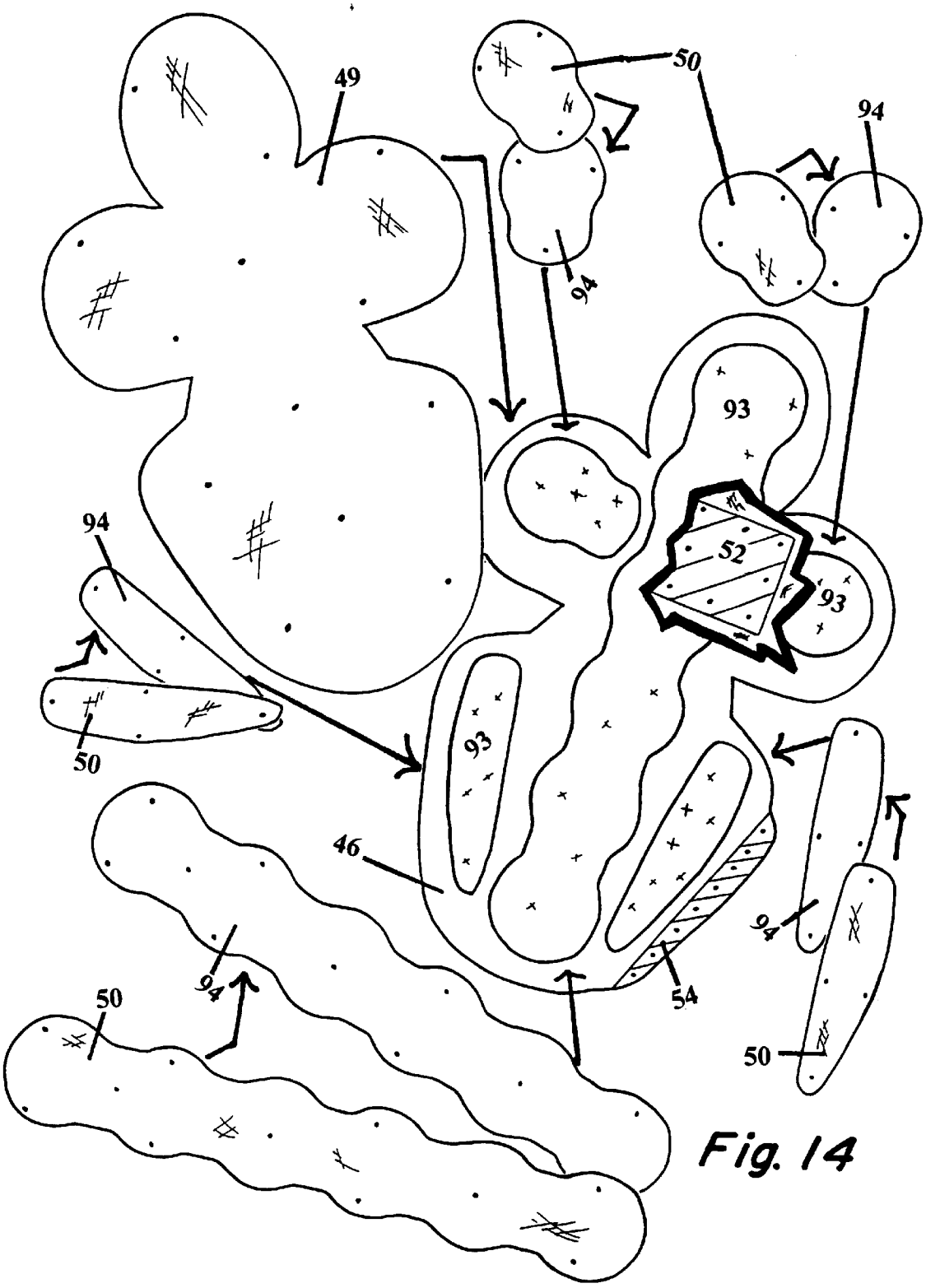
FIG. 14 is an exploded view of said knee/shin protection pouch preferred embodiment (sans back cover).
Figure 15:
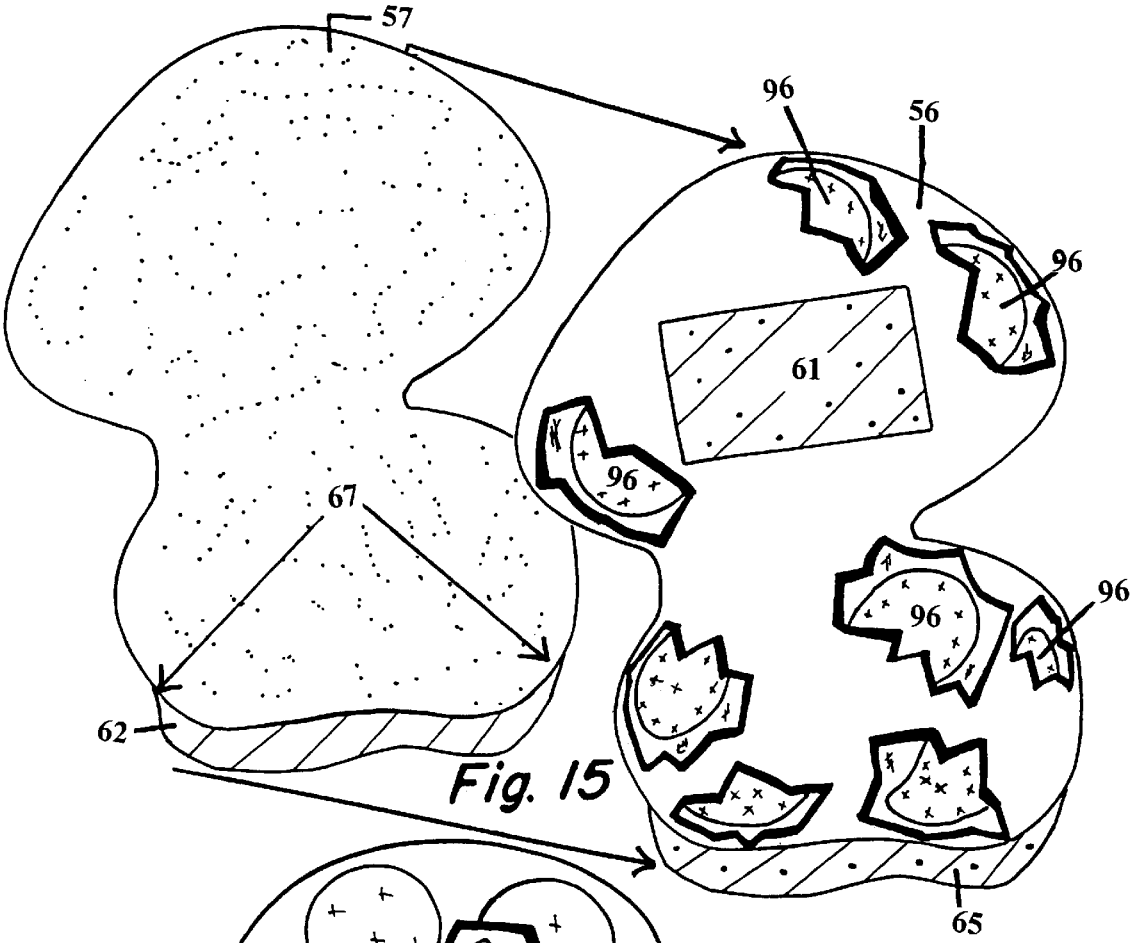
FIG. 15 is an exploded view of said shoulder expansible cloth protection pouch.
Figure 15A:
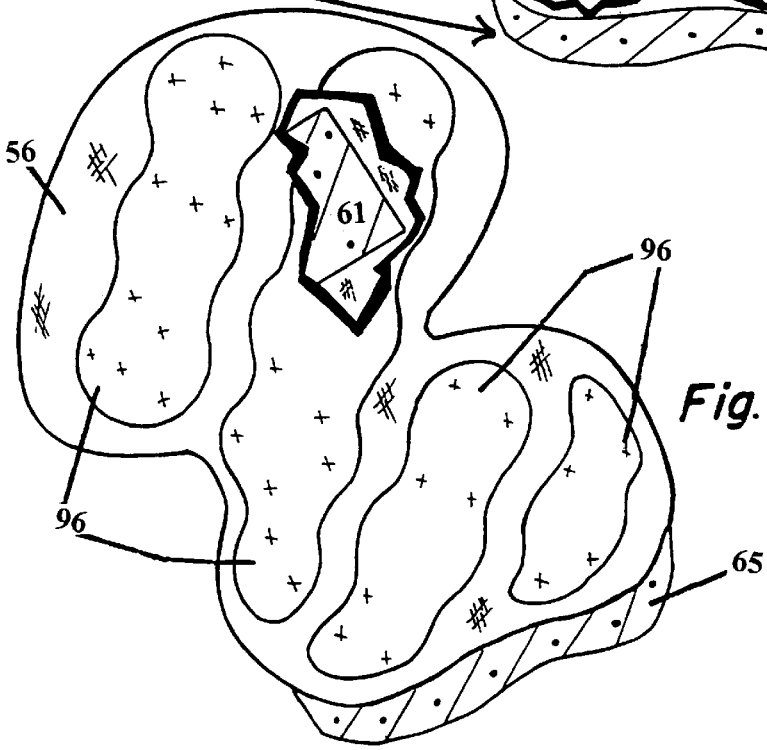
FIG. 15*a* is an inside view of said shoulder protection pouch outer cover.
Figure 16:
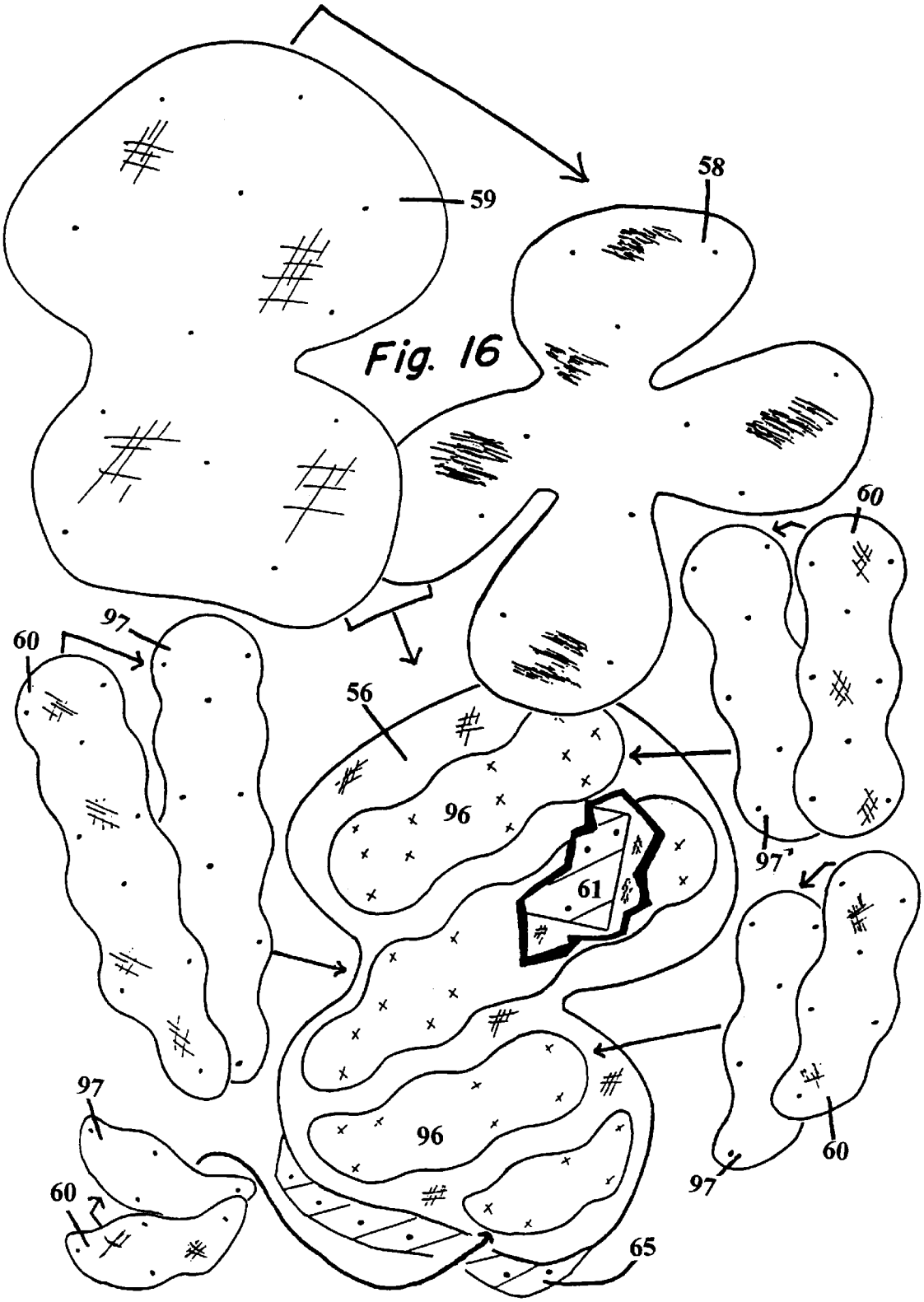
FIG. 16 is an exploded view of said shoulder protection pouch preferred embodiment (sans back cover).
Figure 17:
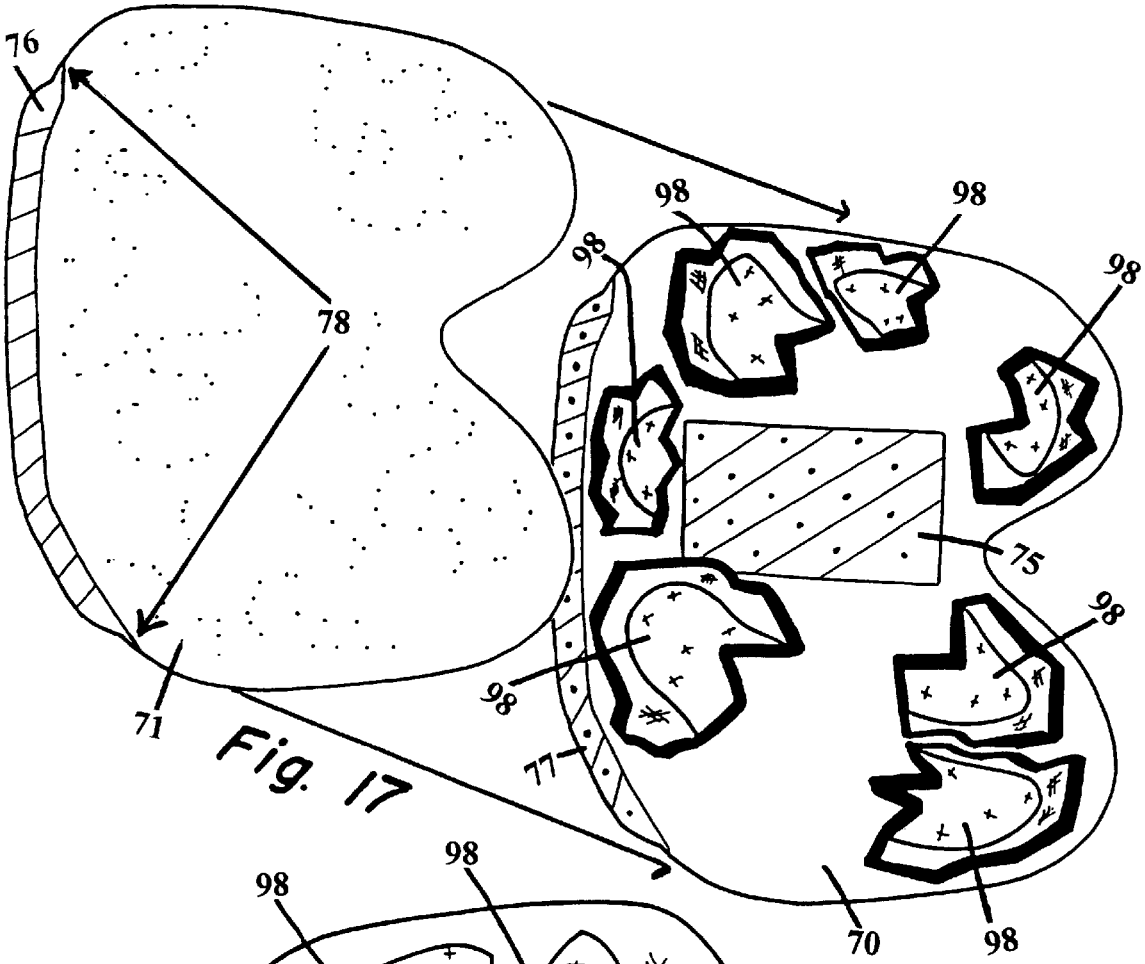
FIG. 17 is an exploded view of said hip/thigh expansible cloth protection pouch.
Figure 17A:
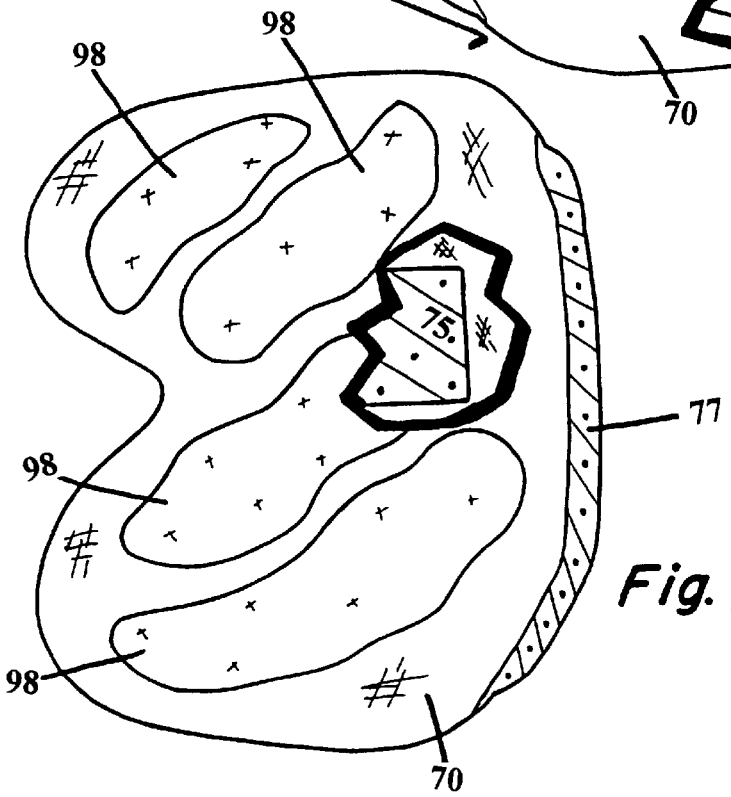
FIG. 17*a* is an inside view of said hip/thigh protection pouch outer cover.

FIGS. 11, 14, 16 and 18, represent said extremity embodiments of the invention. Forearm/elbow, knee/shin, shoulder, and hip/thigh respectively. FIGS. 11, 14 and 16 are views sans back covers. Said extremities' expansible cloth protection pouch consists of two panels. Forearm/elbow, 37 and 38, as shown in FIG. 9, knee/shin, 46 and 47, as shown in FIG. 12, shoulder, 56 and 57, as shown in FIG. 15, and hip/thigh, 70 and 71, as shown in FIG. 17. Said outer covers 37, 46, 56 and 70, as shown in FIGS. 9, 12, 15 and 17 respectively, are constructed from one layer of expansible, breathable, abrasion resistant stretch material. Said back covers, 38, 47, 57 and 71, as shown in FIGS. 9, 12, 15 and 17 respectively, are constructed from one layer of breathable nylon mesh stretch material. Hook attachment-adjusting systems, 42, 52, 61 and 75, as shown in FIGS. 9, 12, 15 and 17 respectively, which gives wearer's horizontal and vertical adjustment capabilities when said pouches are worn beneath outer wear, are sewn onto the outside of said protection pouch's outer cover, 37, 46, 56 and 70, as shown in FIGS. 9, 12, 15 and 17 respectively.

Figure 18:
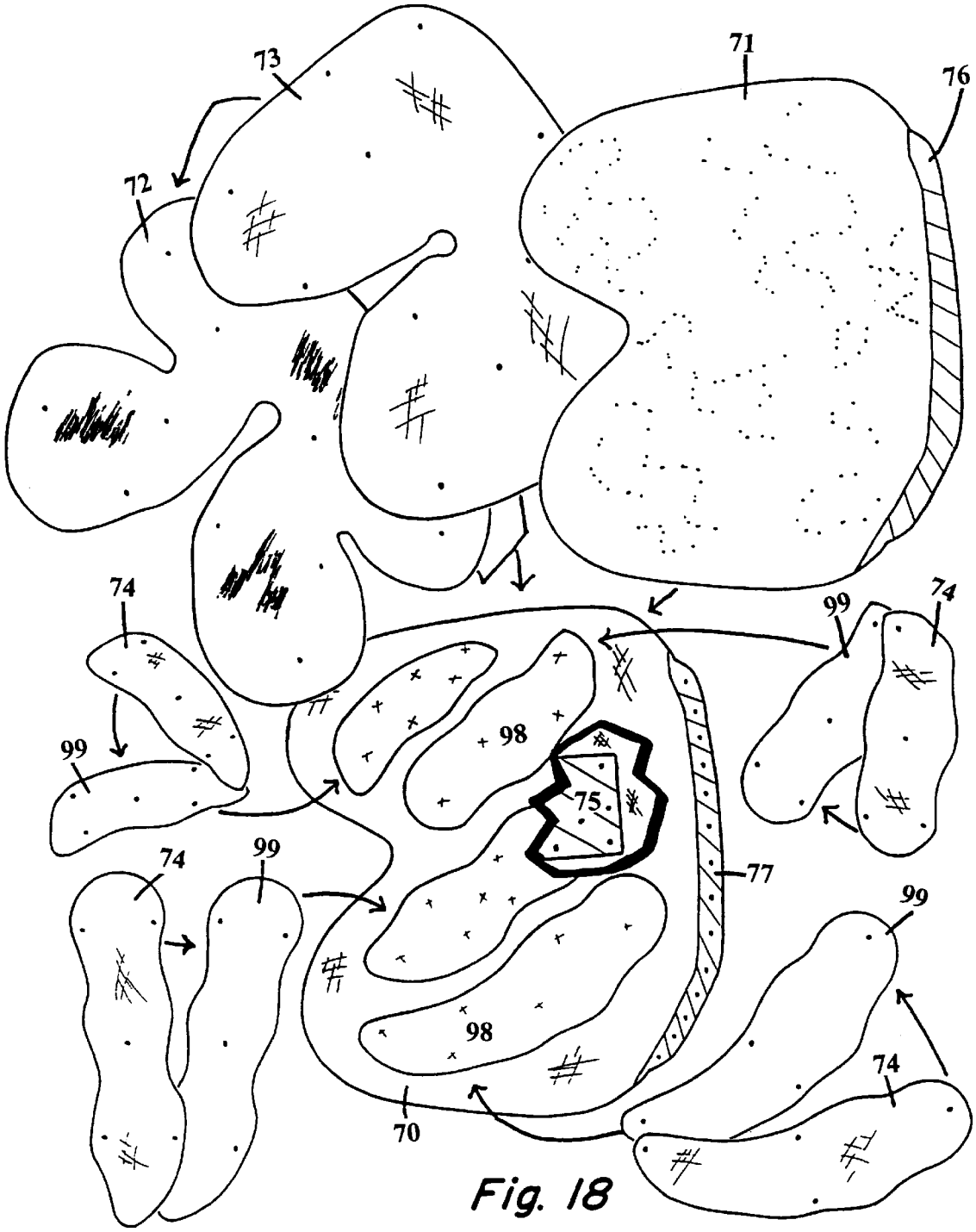
FIG. 18 is an exploded view of said hip/thigh protection pouch preferred embodiment.

Said extremities' protection pouch features the inward fold access portal opening, 45, 55, 67 and 78 as shown in FIGS. 9, 12, 15 and 17 respectively. It is through this opening that all removable replaceable internal impact deceleration control components consisting of primary, 40, 49, 59 and 73, and secondary, 41, 50, 60 and 74, replaceable nitrile foam impact dispersant inserts, as shown in FIGS. 11, 14, 16 and 18; Optional, abrasion-penetration resistant, flexible polyethylene impact trauma shields, 58 and 72, as shown in FIGS. 16 and 18; and replaceable penetration resistant trauma shields, 91, 94, 97 and 99, as shown in FIGS. 11, 14, 16 and 18 respectively, are inserted and removed. The hook and loop closure, 43 and 44, 54 and 53, 65 and 62, and 77 and 76, as shown in FIGS. 9, 12, 15 and 17 respectively, folds and secures inwardly to reduce the chance said access portal opening will sustain snagging or abrasion damage.

Prior to assembly of said extremities' expansible cloth protection pouch, FIGS. 9, 12, 15 and 17 respectively, nylon stretch mesh alignment pockets, 90, 93, 96 and 98 as shown in FIGS. 9*a,* 14, 15*a,* and 17*a* respectively, are positioned and then sewn onto the underside of said extremities' replaceable expansible cloth protection pouch outer cover as shown in FIGS. 9*a,* 14, 15*a* and 17*a* respectively. Said alignment pockets, 90, 93, 96 and 98, as shown in FIGS. 11, 14, 16 and 18 respectively, properly position said extremities' replaceable impact trauma shields, 91, 94, 97 and 99, as shown in FIGS. 11, 14, 16 and 18 respectively, and said secondary nitrile foam replaceable impact dispersant inserts, 41, 50, 60 and 74, as shown in FIGS. 11, 14, 16 and 18 respectively, and said secondary nitrile foam replaceable impact dispersant inserts, 41, 50, 60 and 74, as shown in FIGS. 11, 14, 16 and 18 respectively, once said aforementioned deceleration control components are inserted into said extremities' replaceable expansible cloth protection pouch outer cover, 37, 46, 56 and 70, as shown in FIGS. 11, 14, 16 and 18 respectively. Outer and back covers of said extremities' replaceable expansible cloth protection pouch, 37 an 38, 46 and 47, 56 and 57, and 70 and 71, as shown in FIGS. 9, 12, 15 and 17 respectively, are assembled inside out prior to sewing in order to avoid abrasion damage to the thread. Nylon thread is used at thirteen stitches per inch for strength durability.

Figure 10:
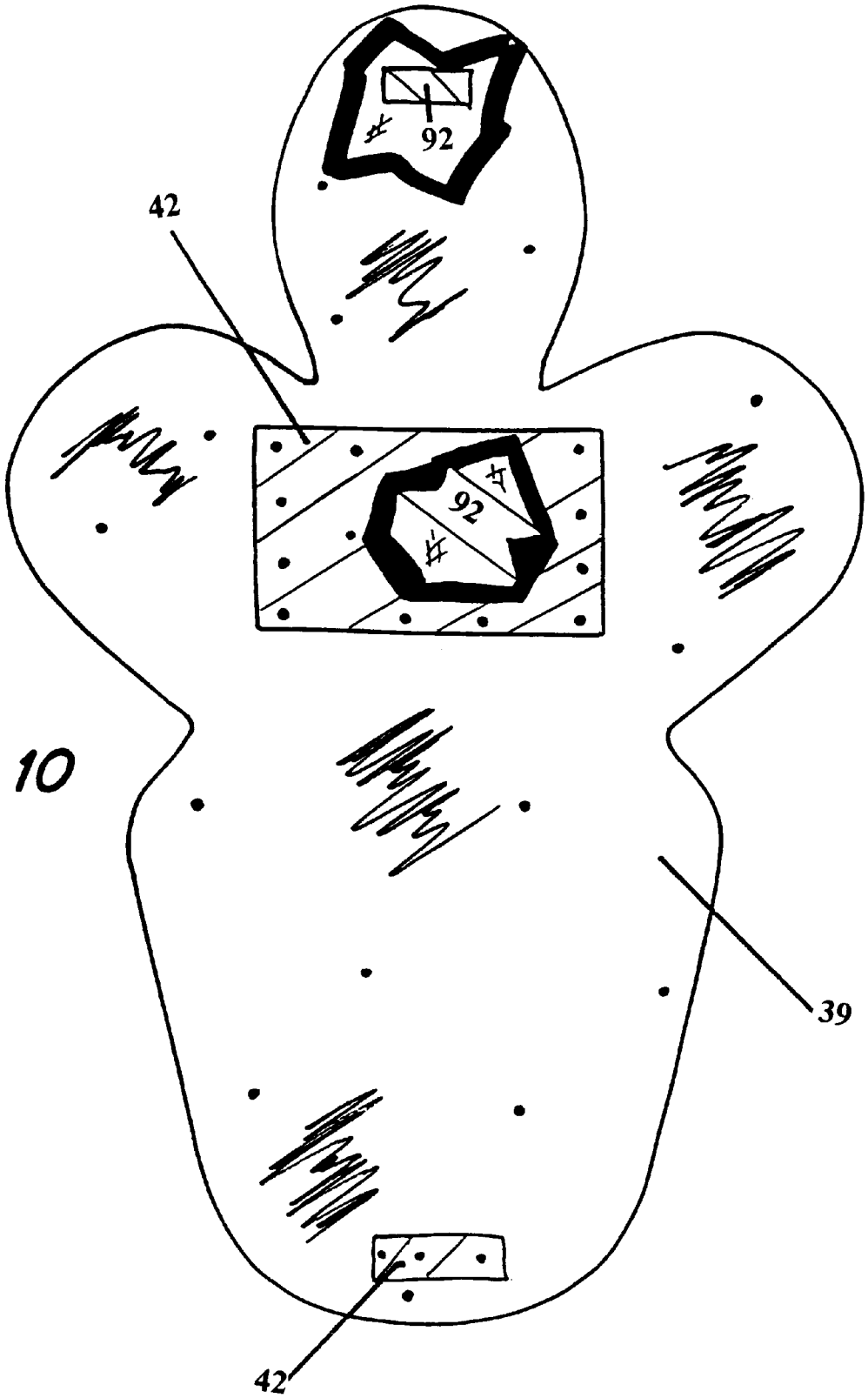
FIG. 10 is an outside view of said forearm/elbow protection pouch's optional, external polyethelene impact trauma shield.
Figure 13:
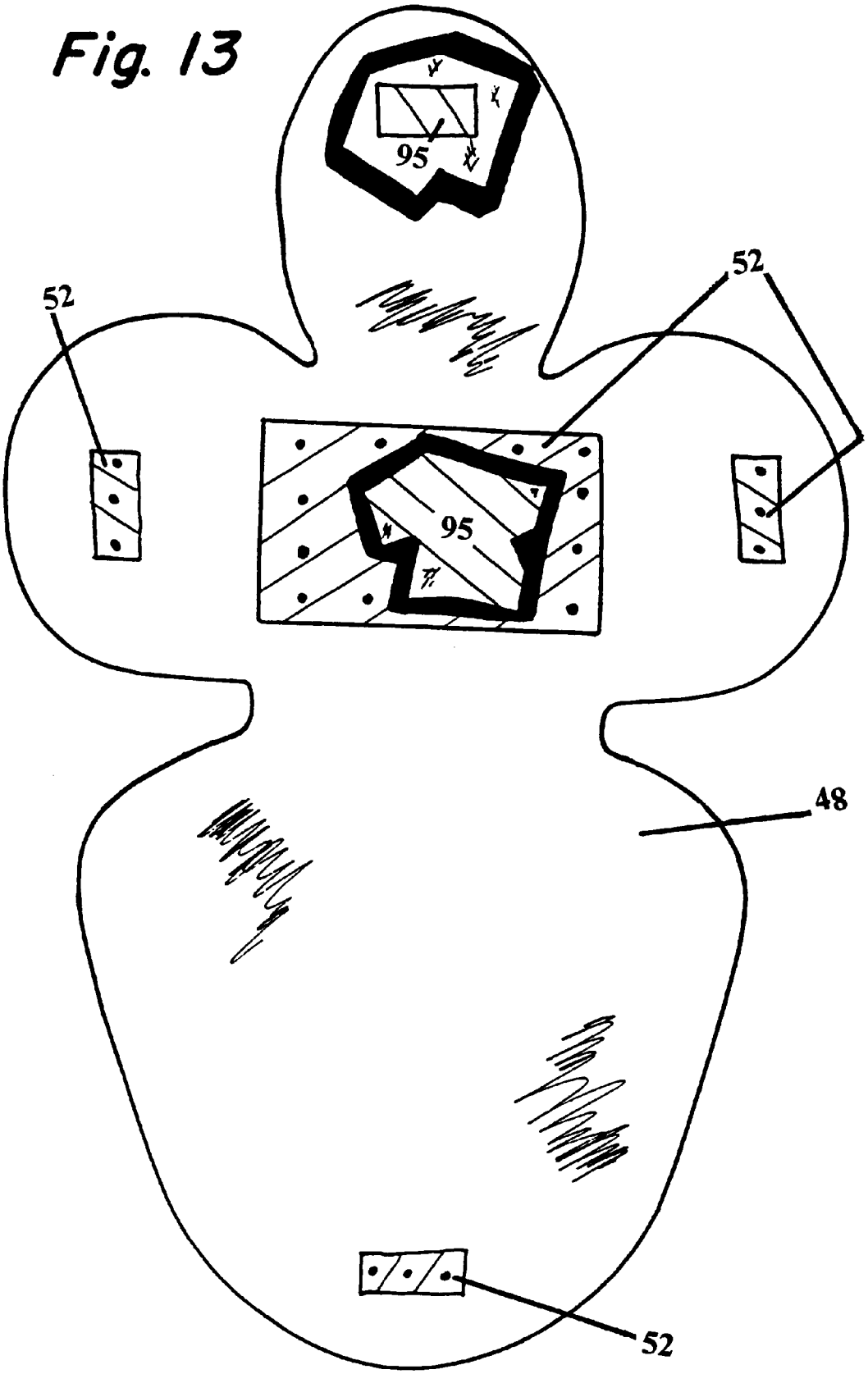
FIG. 13 is an outside view of said knee/shin protection pouch's optional, external polyethelene impact trauma shield.

Optional, external abrasion-penetration resistant, flexible polyethylene impact trauma shields for forearm/elbow, and knee/shin, 39 and 48, as shown in FIGS. 10 and 13 respectively, are attached to said forearm/elbow, and knee/shin protection pouch outer covers hook attachment-adjusting system, 42 and 52, as shown in FIGS. 9 and 12. Said flexible polyethylene impact trauma shields, FIGS. 10 and 13, are attached to said aforementioned hook attachment-adjusting systems via loop fastening systems, 92 and 95, as shown in FIGS. 10 and 13, which are positioned and sewn onto the inside surface area of said aforementioned flexible polyethylene impact trauma shield.

Forearm/elbow and knee/shin protection pouch systems, FIGS. 11 and 14, may also be attached directly to wearers limbs. Elastic straps for this purpose (not shown), may be attached to said flexible polyethylene impact trauma shields loop fastening systems, 92 and 95, which were previously described.

Although the invention has been described in clear detail as demonstrated in the above preferred embodiments, it is done so with the knowledge that variations or improvements to the preferred embodiments are inevitable in the future.

The embodiments of the invention in which an exclusive property or privilege is claimed are defined as follows:

1. A protective garment wearable overlying a portion of a person to both resist penetration of the garment and to disperse impact energy from objects hitting the garment, the garment comprising in combination:

at least one pouch having an interior;

at least one impact disbursing insert removably located within said interior of said pouch;

at least one penetration resistant insert removably located within said interior of said pouch;

wherein said impact disbursing insert is supported within said pouch in a manner allowing said impact disbursing insert to freely expand laterally when impacted; and wherein said pouch is formed from elastic material having sufficient elasticity to allow lateral expansion of said impact disbursing insert when said impact disbursing insert is located within said pouch and is impacted.

2. The protective garment of claim 1 wherein said pouch includes an outer cover formed of abrasion resistant material and an inner cover formed of a highly breathable porous material, both said outer cover and said inner cover formed from an elastic material which is sufficiently elastic to allow expansion of said impact disbursing insert within said pouch when impacted.

3. A protective garment wearable overlying a portion of a person to both resist penetration of the garment and to disperse impact energy from objects hitting the garment, the garment comprising in combination:

at least one pouch having an interior;

at least one impact disbursing insert removably located within said interior of said pouch;

at least one penetration resistant insert removably located within said interior of said pouch;

wherein said impact disbursing insert is located closer to the person that said penetration resistant insert;

wherein said penetration resistant insert is attached to an outer cover of said pouch on a side of said outer cover within said interior, such that said penetration resistant insert remains substantially fixed in position relative to said outer cover of said pouch;

wherein said outer cover includes pockets within said interior of said pouch, said pockets sized to receive at least a portion of at least one penetration resistant insert within each said pocket; and wherein said outer cover is formed of abrasion resistant material and an inner cover of said pouch opposite said outer cover is formed of a highly breathable porous material, both said outer cover and said inner cover formed from an elastic material which is sufficiently elastic to allow expansion of said impact disbursing insert within said interior when impacted.

4. The protective garment of claim 3 wherein said impact disbursing insert is formed from a nitrile foam material with holes passing through said impact disbursing insert;

wherein said penetration resistant insert is formed from a hydrocarbon plastic material; and wherein said holes sufficiently exiguous to cause air to be compressed between said impact dispersing insert and said penetration resistant insert when impacted and before the air can travel through said holes, such that trapped air is compressed to absorb a portion of impact forces exerted on said pouch.

5. An adjustably protective garment wearable overlying a portion of a wearer, the garment comprising in combination:

at least one pouch having an interior;

at least one protective insert removably locatable within said interior, said protective insert having protective characteristics matching desired protective characteristics for said garment;

wherein said at least one protective insert is a penetration resistant insert; and wherein at least one pocket is located within said interior of said pouch, said penetration resistant insert sized to fit at least partially within said pocket within said interior of said pouch to hold said penetration resistant insert in a fixed position relative to said pouch.

6. The adjustably protective garment of claim 5 wherein at least one protective insert is configured as a impact disbursing insert within said interior of said pouch, said impact disbursing insert located within said interior of said pouch but outside of said pocket, said impact disbursing insert located on a side of said pocket closer to the wearer.

* * * * *